US009960556B1

(12) United States Patent
Jansma et al.

(10) Patent No.: US 9,960,556 B1
(45) Date of Patent: May 1, 2018

(54) POWER DISTRIBUTIONS UNITS AND ORIENTATION OF POWER OUTLETS

(71) Applicants: Michael Jansma, Eureka, MO (US); Karl Klaus Dittus, Raleigh, NC (US)

(72) Inventors: Michael Jansma, Eureka, MO (US); Karl Klaus Dittus, Raleigh, NC (US)

(73) Assignee: CIS Global LLC, Tucson, AZ (US)

( * ) Notice: Subject to any disclaimer, the term of this patent is extended or adjusted under 35 U.S.C. 154(b) by 0 days. days.

(21) Appl. No.: 15/437,994

(22) Filed: Feb. 21, 2017

(51) Int. Cl.
*H01R 13/625* (2006.01)
*H01R 27/02* (2006.01)
*H01R 13/639* (2006.01)

(52) U.S. Cl.
CPC ..... *H01R 27/02* (2013.01); *H01R 13/6395* (2013.01)

(58) Field of Classification Search
CPC ..... H01R 13/6275; H01R 25/003; H01R 13/7175; H01R 33/09
USPC ..... 439/345, 214, 490, 375
See application file for complete search history.

(56) References Cited

U.S. PATENT DOCUMENTS

| | | | | |
|---|---|---|---|---|
| 8,038,454 | B2 | 10/2011 | Jiang et al. | |
| 8,283,802 | B2 | 10/2012 | Jansma et al. | |
| 2013/0122750 | A1* | 5/2013 | Jansma | H01R 13/6272 439/650 |
| 2013/0196532 | A1* | 8/2013 | Utz | H01R 13/5812 439/471 |
| 2015/0044900 | A1 | 2/2015 | Mcdowall | |

* cited by examiner

*Primary Examiner* — Phuong Chi T Nguyen
(74) *Attorney, Agent, or Firm* — Seyfarth Shaw LLP

(57) ABSTRACT

High power outlet count PDUs are disclosed having sufficient access to latching features in basic, metered, and managed PDUs. The power outlets may be oriented and spaced apart from one another to allow sufficient access to a latch of a corresponding plug such that plugs may individually be removed from the corresponding power outlets with ease. For example, the power outlets may be arranged longitudinally along the PDU, and staggered widthwise and/or rotated to allow access to the latch(es).

20 Claims, 8 Drawing Sheets

POWER DISTRIBUTIONS UNITS AND ORIENTATION OF POWER OUTLETS

FIELD

The present invention relates generally to power distribution units. More particularly, the present invention relates to improved orientations for power outlets of power distribution units.

BACKGROUND

Computer servers, such as those used in computer and telecommunication systems, are typically mounted within racks or cabinets. Power distribution units (PDUs) are used to provide power to one or more electronic devices, such as servers and other electronics, mounted within or connected to such racks.

One of the problems with PDUs is the possibility of accidentally unplugging power connectors or plugs during shipping of the rack and/or during service operations. Attempts have been made to address this unplugging issue by incorporating latching mechanisms into the PDUs and plugs to lock the plugs to the PDUs. For example, U.S. Patent Application Publication No. 2015/0044900 discloses custom retention mechanisms, U.S. Pat. No. 8,038,454 discloses a latching mechanism on a top side of the plugs, and U.S. Pat. No. 8,283,802 discloses another arrangement where a latching mechanism on a top side of the plugs is used.

However, these current solutions require reducing outlet count to allow access to the latching mechanism on the plugs, or make access to the latching mechanism on the plugs difficult when the PDU is installed (for example on a rack).

SUMMARY

The present invention relates to an arrangement of power outlets for power distribution units (PDUs) having sufficient access to latching features. The power outlets may be oriented and spaced apart from one another to allow sufficient access to a latch of a corresponding plug such that plugs may individually be removed from the corresponding power outlets with ease. For example, the power outlets may be arranged longitudinally along the PDU, and the staggered widthwise to allow access to the latch(es).

In an embodiment, a device adapted to receive first and second power connectors is disclosed. Each of the power connectors has a connector width. The device includes first and second power outlets adapted to respectively receive the first and second power connectors. The first and second power outlets are arranged longitudinally along the device. The second power outlet is rotated 180 degrees with respect to the first power outlet, and is spaced from the first power outlet along a width of the device by a first distance of about 35% to 99% of the connector width. A first recess is also in the first power outlet and is adapted to receive a first latch of the first power connector to couple the first power connector with the first power outlet.

In another embodiment, a device adapted to receive first and second power connectors is disclosed. Each of the power connectors has a connector width. The device includes first and second power outlets adapted to respectively receive the first and second power connectors. The first and second power outlets are arranged longitudinally along the device, and the second power outlet is spaced from the first power outlet along a width of the device by a first distance of about 35% to 99% of the connector width. A first recess is also in the first power outlet and is adapted to receive a first latch of the first power connector to couple the first power connector with the first power outlet.

In another embodiment, a device adapted to receive first and second power connectors is disclosed. The device includes first and second power outlets adapted to respectively receive the first and second power connectors. A tie down portion is also disposed proximal to the first power outlet. The tie down portion is recessed and includes a tie down recess with a bridge portion extending across the tie down recess. This allows for the first power connector to be coupled to the recess.

BRIEF DESCRIPTION OF THE DRAWINGS

For the purpose of facilitating an understanding of the invention, there are illustrated in the accompanying drawings embodiments thereof when considered in connection with the following description, the invention, its construction and operation, and many of its advantages should be readily understood and appreciated.

DETAILED DESCRIPTION

Figure 1:
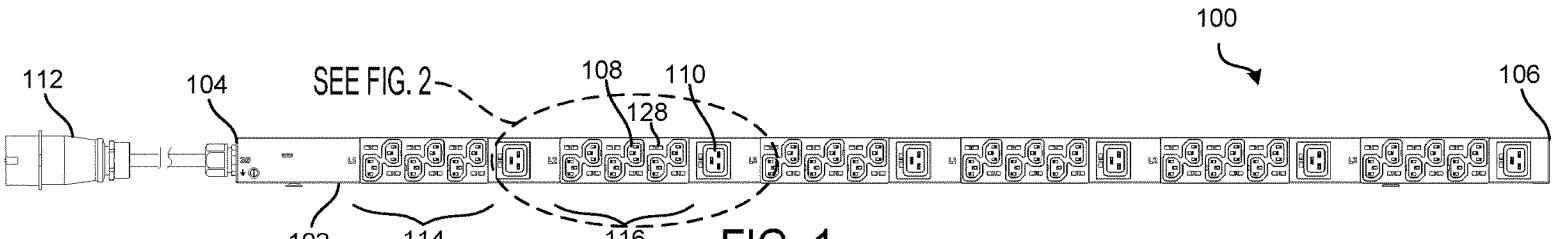
FIG. 1 is a top view of a power distribution unit (PDU) according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

As equipment rack density continues to increase, outlet count or power outlet count of power distribution units (PDUs) continues to be an important factor. Embodiments of the present invention provide for high power outlet count PDUs having sufficient access to latching features in basic, metered, and managed PDUs. The aspects of the embodiments of the invention may be applied to vertical "strip" PDUs, and horizontal PDUs. The aspects of the embodiments of the invention may also be applied to top, side, and/or custom latching type power outlets.

Referring to FIG. 1, a PDU 100 includes a housing 102 having first and second opposing ends 104, 106. One or more power outlets 108, 110 are disposed on or in the housing between the first and second ends 104, 106. A input (or mains) power connector 112 may also be electrically coupled to the first end 104 and adapted to couple to a power source for supplying power to the one or more power outlets 108, 110.

The PDU 100 may include groups of power outlets 108, 110. For example, a first group 114, a second group 116, etc. As illustrated in FIG. 1, the PDU 100 includes six groups. Each power outlet 108, 110 in each group may be individual, part of a subgroup, or part of a subassembly of power outlets. In the interest of brevity, the PDU 100 is described in further detail with respect to the second group 116. However, it should be appreciated that the other groups are substantially similar.

Figure 2:
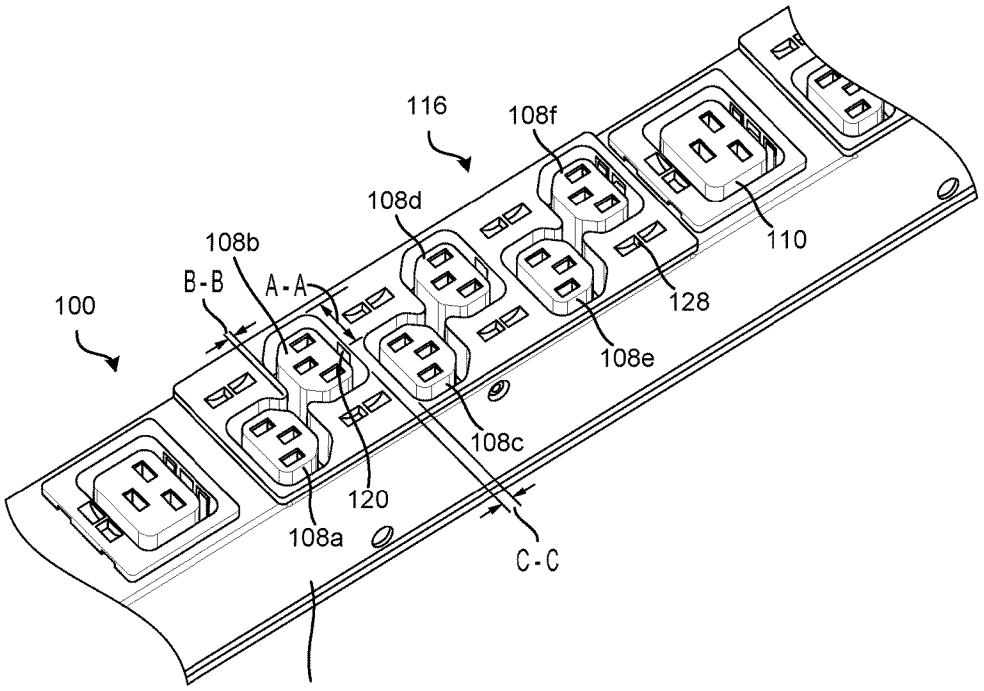
FIG. 2 is an enlarged, perspective view of a portion of the PDU of FIG. 1, illustrating spacing between power outlets.
Figure 3:
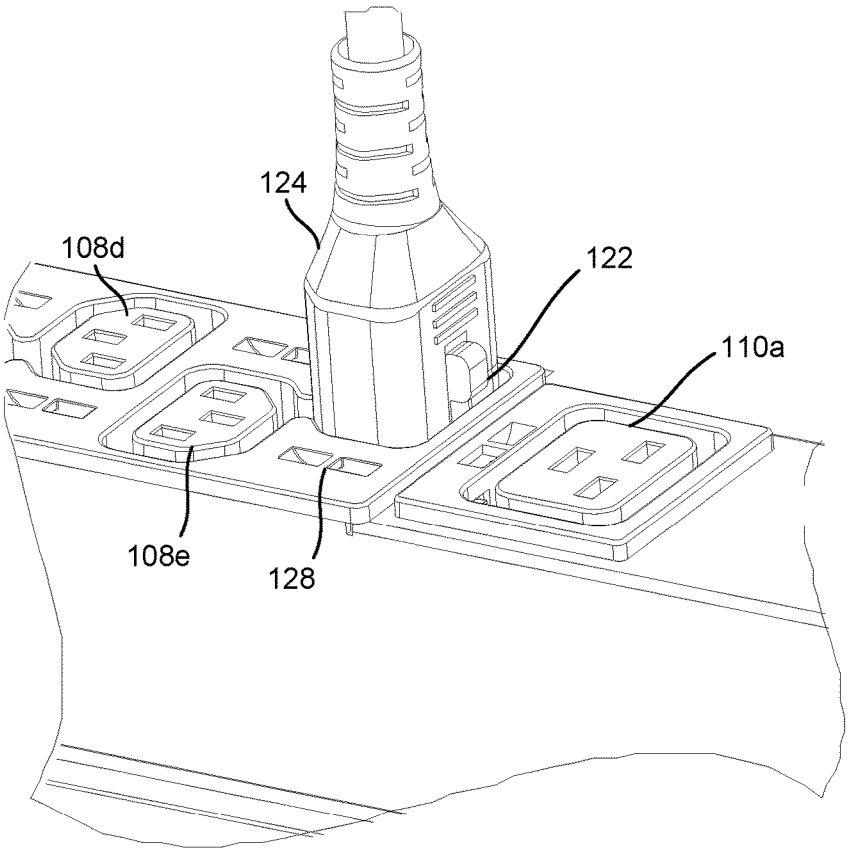
FIG. 3 is an enlarged, perspective view of a portion of the PDU of FIG. 1, illustrating a plug disposed in a power outlet.

Referring to FIGS. 2 and 3, the second group 116 includes first through sixth power outlets 108*a-f*, and one or more power outlets 110*a* may be disposed proximal to the second group 116. Each of the first through sixth power outlets 108*a-f* and/or the power outlet 110*a* may be a standard receptacle type, for example, IEC C13, IEC C15, IEC C19, IEC C21, or may be other types of power outlets.

As illustrated, Each of the first through sixth power outlets 108*a-f* include a retaining recess 120 adapted to receive a latch portion or lever 122 of a corresponding power connector or plug 124 when the plug 124 is inserted into the corresponding power outlet 108*a-f*. This provides for a locking mechanism that locks and retains the plug 124 in the corresponding power outlet to resist inadvertent unplugging of the plug 124 from the PDU 100. For example, when the plug 124 is inserted into the corresponding power outlet, such as power outlet 108*f*, the lever 122 engages the recess 120 to lock the plug 124 in the power outlet 108*f*. To remove the plug 124 from the power outlet 108*f*, the lever 122 is pushed in, moved up, or moved down in order to disengage the lever 122 from the recess 120, which allows the plug 124 to be pulled out of the power outlet 108*f*.

As illustrated, the retaining recesses 120 are disposed in the corresponding power outlets 108*a-f* at a first side (or top side) of the corresponding power outlets 108*a-f*. Similarly, the power outlet 110*a* may include a recess 120 at a first side (or top side) of the power outlet 110*a*. However, it should be appreciated that the power outlets 108*a-f*, 110*a* may have retaining recesses 120 and the corresponding plugs 124 have levers 122 located in other positions, such as at a second, third or fourth side of the corresponding power outlets 108*a-f*, 110*a*.

Figure 4:
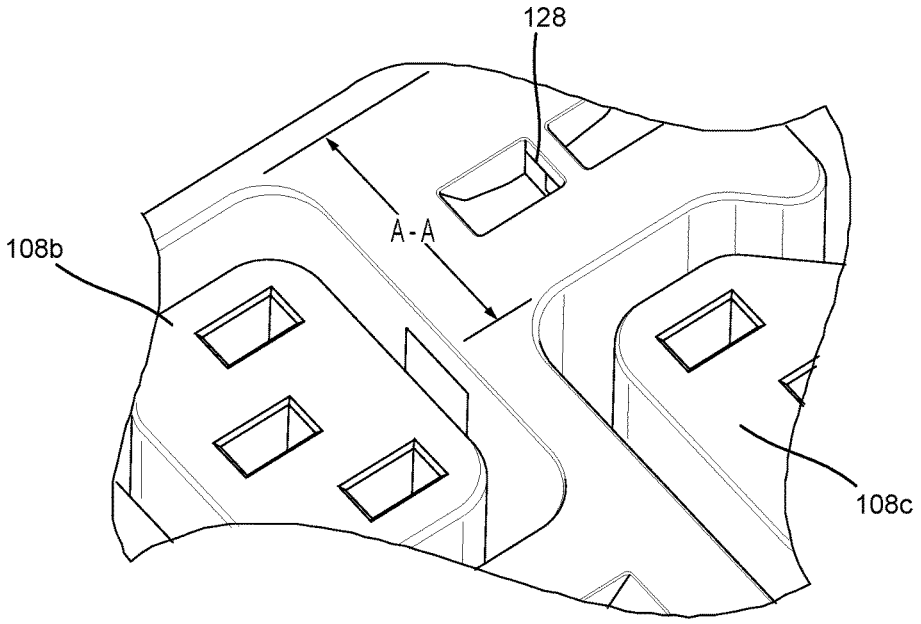
FIGS. 4 and 5 are enlarged views of the PDU of FIG. 1.
Figure 5:
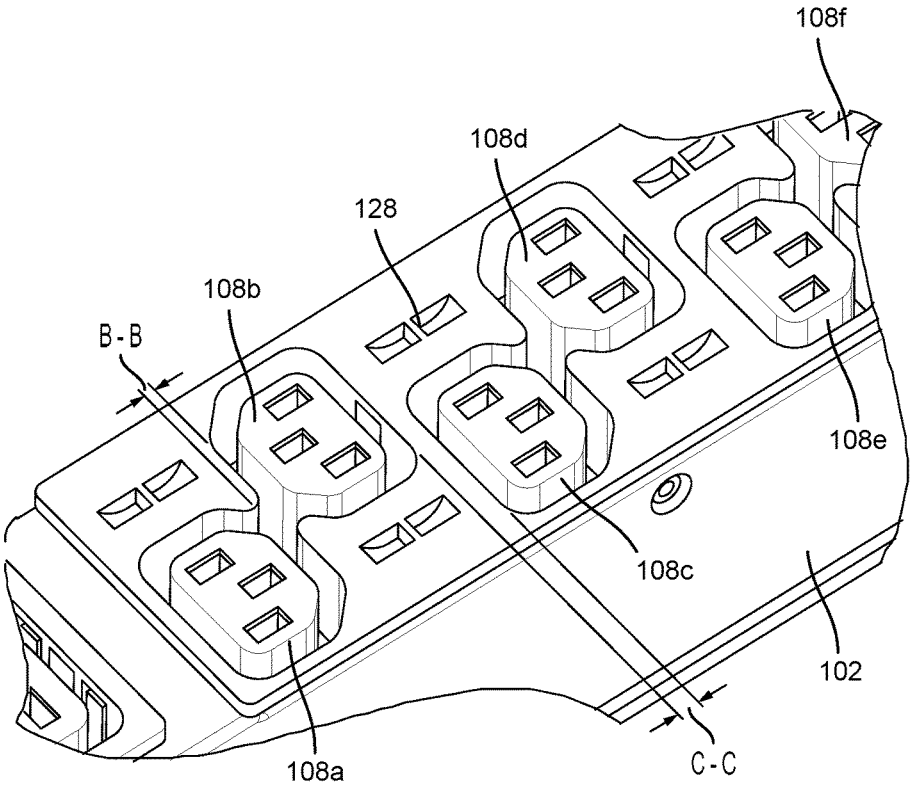

The first through sixth power outlets 108*a-f* are oriented and spaced apart from one another to allow sufficient access to the latches 122 of the corresponding plugs 124 such that the plugs 124 may individually be removed from the corresponding power outlet 108*a-f* with ease. For example, referring to FIGS. 2, 4, and 5, the first through sixth power outlets 108*a-f* are arranged longitudinally along the PDU 100, and the first through sixth power outlets 108*a-f* may be staggered with respect to adjacent ones of the power outlets 180*a-f* longitudinally along the PDU 100. This staggering allows for the number of power outlets within an area to be increased, while allowing for clearance between latches of the plugs and opposing cables of the plugs. The first through sixth power outlets 108*a-f* may also be rotated 180 degrees with respect to adjacent ones of the power outlets 180*a-f*, which also allows for the number of power outlets within an area to be increased, and allows for clearance between latches of the plugs and opposing cables of the plugs. However, it should be appreciated that the first through sixth power outlets 108*a-f* may all be oriented in the same direction, without the 180 degree rotation.

As illustrated, the first, third and fifth power outlets 108*a, c*, and *e* may be aligned with one another along a first line extending longitudinally along the PDU 100. Similarly, the second, fourth and sixth power outlets 108*b, d*, and *f* may be aligned with one another along a second line extending longitudinally along the PDU 100. For example, the power outlets 108*a-f* may be staggered by a distance A-A measured along a width of the PDU 100, and spaced by distances B-B and C-C measured along a length of the PDU 100. For example, the first power outlet 108*a* may be staggered by the distance A-A with respect to the second power outlet 108*b*, and spaced from the second power outlet 108*b* by the distance B-B. Similarly, the third power outlet 108*c* may be staggered by the distance A-A with respect to the second power outlet 108*b* and the fourth power outlet 108*d*, spaced from the second power outlet 108*b* by the distance C-C, and spaced from the fourth connection portion by the distance B-B. Each power outlet 108*a*-108*f* may follow this logic/configuration as illustrated in FIG. 2. In general, when power outlets are not staggered, the distance C-C should be about 13 mm in order to allow for sufficient access to the latches of the plugs. The staggered arrangement allows for the distance C-C to be decreased to a distance of about 0 mm to 8 mm.

The distance A-A may be about 35% to 99% of a width of a power connector, such as plug 124 illustrated in FIG. 3. More preferably, the distance A-A may be greater than or equal to about 50% of a width of a plug, and the distance C-C may be about 0 mm to 7 mm, and more preferably, the distance C-C may be about 0 mm to about 4 mm.

Since some plugs have large radii, even if the latch is shadowed by the cable, clearance is provided to access the latch when the distance A-A is about 35% or greater than the width of a plug. For example, if the distance A-A is greater than 50% of a width of a plug, then distance B-B may be approximately 0 mm and distance C-C may be approximately 0 mm to 5 mm and still provide sufficient clearance to access the latch. More specifically, if the distance A-A is about 55% of a width of a plug, then distance B-B may be approximately 0 mm and distance C-C may be approximately 0 mm and still provide sufficient clearance to access the latch. However, when the distance A-A is about 35%-49%, then distance B-B may be approximately 0 mm and distance C-C may be approximately 4 mm to about 7 mm and still provide sufficient clearance to access the latch; and more preferably, when the distance A-A is about 49%, the distance C-C may be about 4 mm.

The amount of stagger (i.e., distance A-A) affects the overall width of the PDU 100. Accordingly, if the width is constrained, the distance A-A may be reduced and the distance C-C increased. Similarly, if the length of the PDU 100 is constrained, the distance A-A may be increased and the distance C-C reduced.

Another option is to offset the recesses 120 and corresponding latches on the plugs closer to one side, rather than centered. This also provides for clearance to access the latch without requiring as much stagger. For example, with offset recesses and latches, the distance A-A may be greater than or equal to 10% of a width of a plug.

As illustrated, the first through sixth power outlets 108*a-f* are a standard receptacle type, for example, IEC 60320 C13 or IEC C15. However, the first through sixth power outlets

108*a-f* may be any other type of receptacle in accordance with a particular application of the PDU 100. Similarly, the power outlet 110*a* is a standard receptacle type, for example, IEC C19. However, the power outlet 110*a* may be any other type of receptacle in accordance with a particular application of the PDU 100.

The power outlets may also be individual power outlets and/or ganged as part of a subassembly of power outlets that is disposed in or on the PDU 100. For example, as illustrated, in FIG. 2, the second group 116 is a subassembly including the first through sixth power outlets 108*a-f*. However, each of the power outlets 108*a-f* may be individual, or part of other subgroups that are disposed in or in the PDU 100.

Referring to FIGS. 1-5, the PDU 100 and/or a subassembly of power outlets of the PDU 100 may include tie down portions 128 disposed proximal to the respective power outlets. The tie down portions may include recesses with a bridge portion extending across the recess. This provides for a flat form factor of the PDU 100 and/or a subassembly of power outlets of the PDU 100. The tie down portions 128 may be molded into the PDU 100 and/or a subassembly of power outlets of the PDU 100, and allow for ties to be threaded through the recesses and coupled to plugs. This provides a way for non-latching plugs to be used with the power outlets, and allows for such non-latching plugs to be locked or retained with respect to the power outlets to prevent inadvertent unplugging of the non-latching plugs. Further, the recessed nature of the tie down portions 128 allow for the tie down portions 128 to be flush with the PDU 100 and/or a subassembly of power outlets of the PDU 100. This allows for the PDU 100 and/or a subassembly of power outlets of the PDU 100 to face inwardly of an equipment rack without requiring additional space for protrusions (such as protruding tie down portions).

Figure 6:
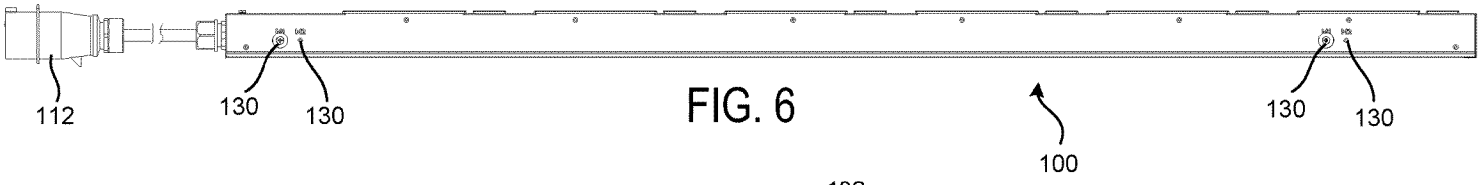
FIG. 6 is a side view of the PDU of FIG. 1.
Figure 9:
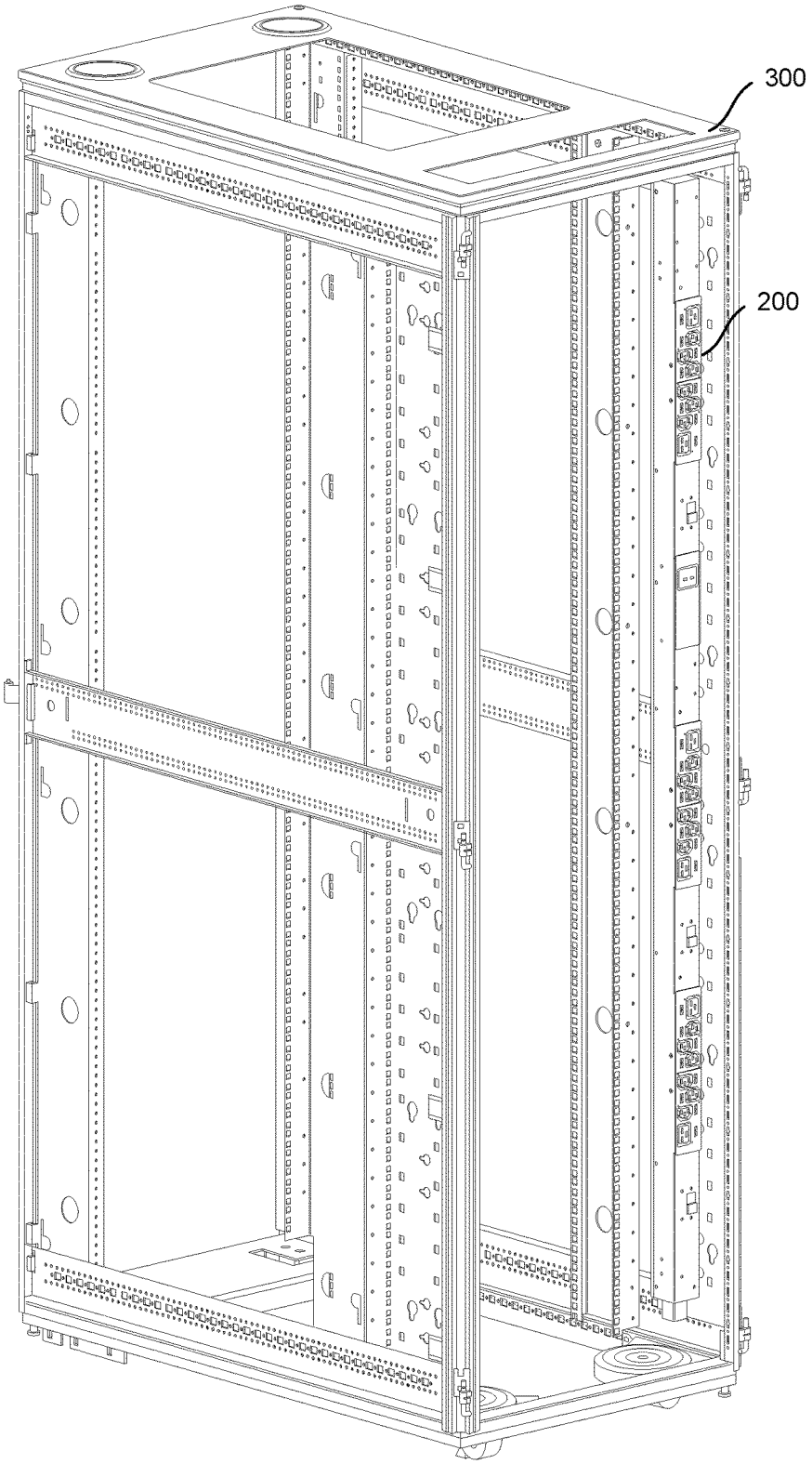
FIG. 9 is a perspective view of an exemplary equipment rack with a PDU mounted thereon according to an embodiment of the present invention.

Referring to FIG. 6, the PDU 100 may include one or more mounting brackets or apertures 130 to allow the PDU 100 to be coupled to an equipment rack, for example as described in further detail with respect to FIG. 9. The mounting brackets or apertures 130 may be disposed on or in a side, back or other area of the PDU 100. As illustrated in FIG. 6, the mounting brackets or apertures 130 are disposed in a side of the PDU 100.

Figure 7:
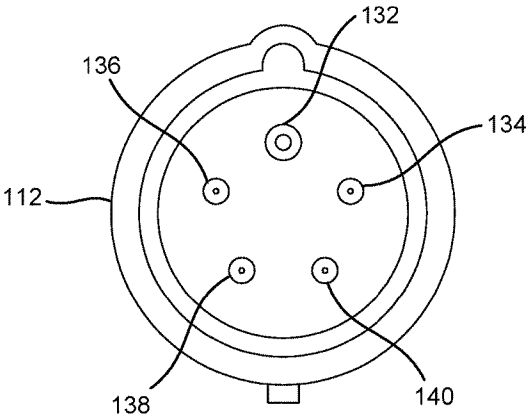
FIG. 7 is an enlarged view of an exemplary power connector of the PDU of FIG. 1.
Figure 8:
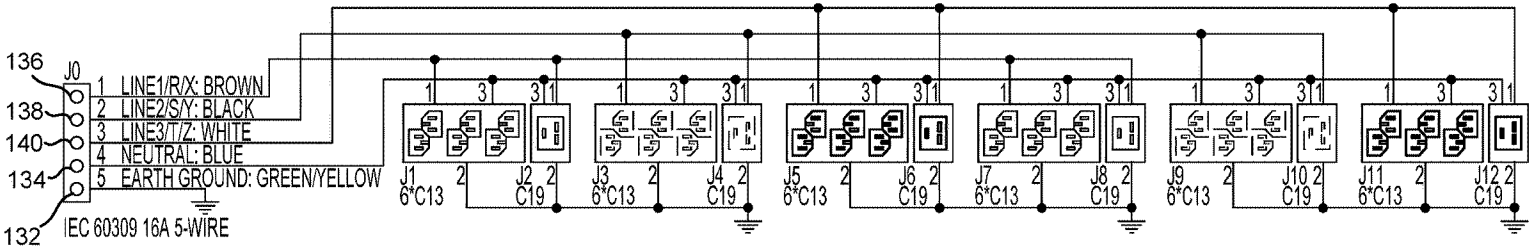
FIG. 8 is an exemplary simplified wiring scheme of the PDU of FIG. 1.

Referring to FIGS. 7 and 8, one example of a PDU 100 may be a three-phase-Wye PDU 100. Accordingly, the power connector 112 may include a number of wiring connections, for example, a ground 132, a neutral 134, a hot line X 136, a hot line Y 138, and a hot line Z 140. Further, the PDU 100 may have the wiring scheme illustrated in FIG. 8. However, the PDU 100 may be any other type pf PDU, such as a single phase, split phase, three-phase-Wye, three-phase-Delta, etc.

In an embodiment, the staggering scheme described above may be implemented in connection with other PDU arrangements. For example, referring to FIGS. 9 and 10, PDU 200 may be coupled to an equipment rack 300. As illustrated, the PDU 200 includes one or more power outlets 208, such as a first group containing first through third power outlets 208*a-c*; and a power outlet 210 (which is rotated about 90 degrees from that of power outlet 110 described above).

Figure 10:
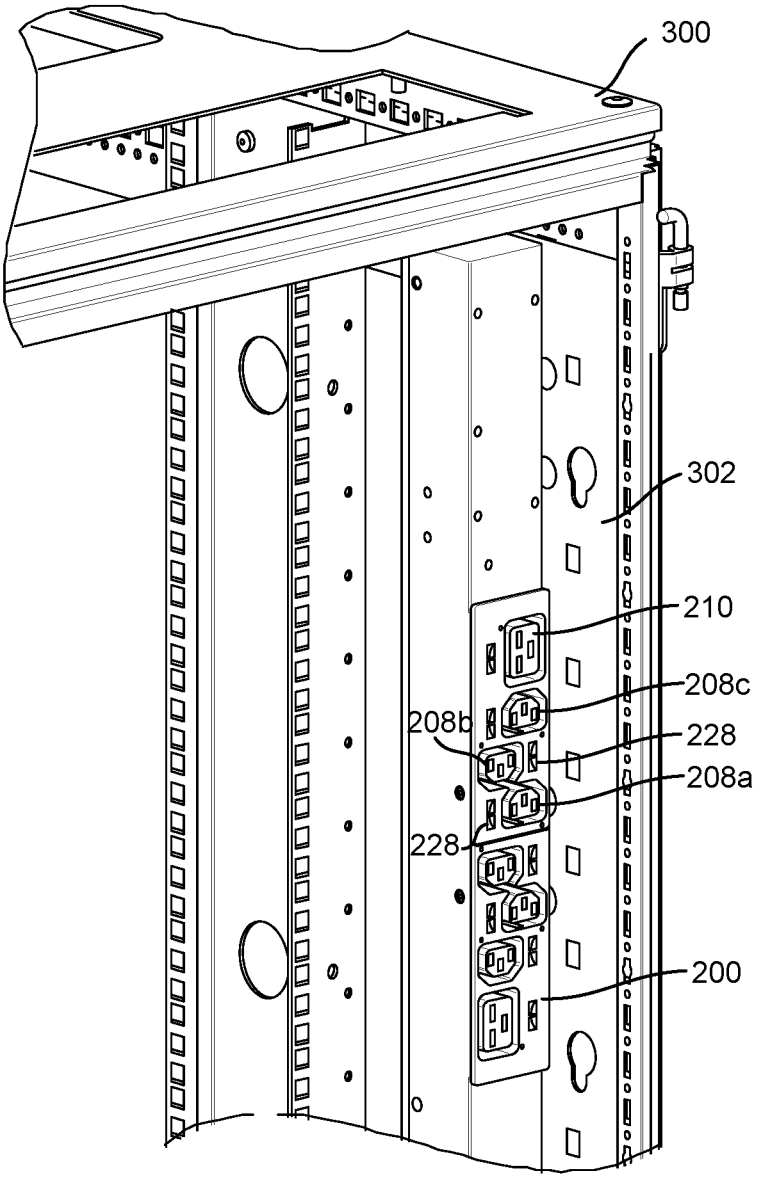
FIG. 10 is an enlarged perspective view of the PDU of FIG. 9.

As described above, the power outlets 208*a-c* may be staggered by a distance A-A measured along a width of the PDU 200. For example, the first power outlet 208*a* may be rotated 180 degrees and staggered by the distance A-A with respect to the second power outlet 208*b*. Similarly, the third power outlet 208*c* may be rotated 180 degrees and staggered by the distance A-A with respect to the second power outlet 208*b*. Each power outlet 208 may follow this configuration/logic, as illustrated in FIG. 10. The PDU 200 and/or subassembly of power outlets of the PDU 200 may include recessed tie down portions 228, that include recesses with a bridge portion extending across the recess, similar to the tie down portions 128 described above.

Referring to FIG. 10, the orientation and layout of the power outlets in the PDU 200 (and PDU 100 as well) allow for clearance to access latches of the corresponding plugs, regardless of the orientation of the PDU in the equipment rack. For example, the orientation and layout of the power outlets allows for clearance from a side 302 of the equipment rack 300, as well as other parts of the equipment rack 300.

Figure 11:
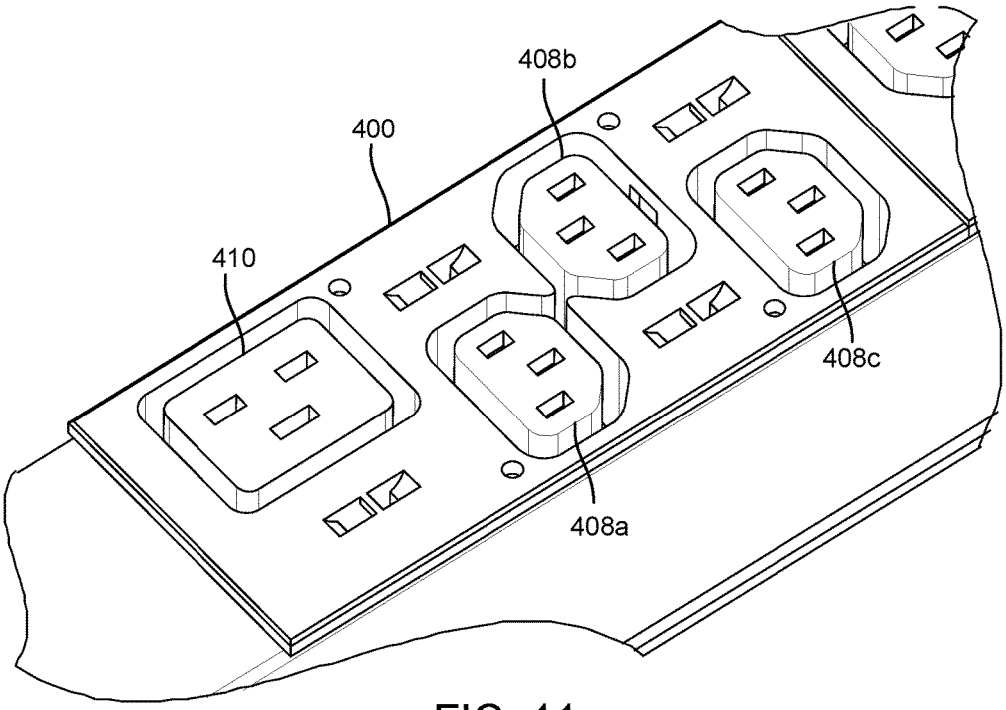
FIGS. 11-12 are perspective views of additional embodiments of power outlet arrangements for PDUs according to embodiments of the present invention.

It should be appreciated that the orientation of the additional power outlets, such as power outlets 110 and 210 within a PDU may be altered or switched to provide clearance to a corresponding latch of a plug connection to the power outlet(s). For example, as illustrated in FIG. 11, PDU 400 may include one or more power outlets 408, such as a first group containing first through third power outlets 408*a-c*; and a power outlet 410 (which is rotated about 90 degrees from that of power outlet 110, and 180 degrees from that of power outlet 210 described above). The power outlets 408*a-c* may be rotated and staggered by a distance A-A measured along a width of the PDU 400, as described above with respect to the PDUs 100 and 200).

Figure 12:
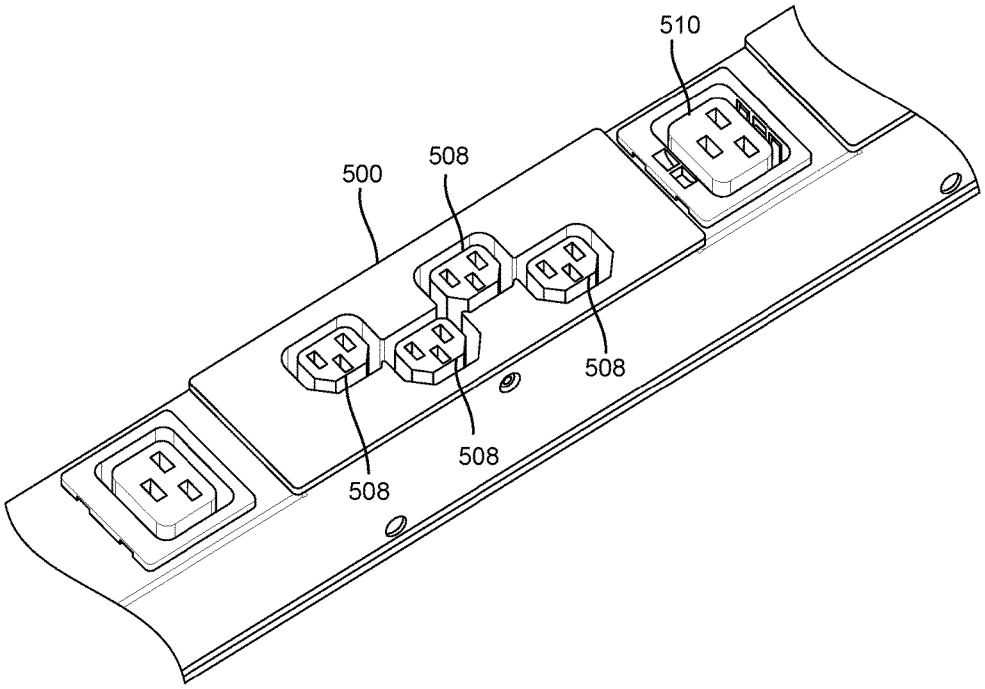

As mentioned above, the aspects of the embodiments of the invention may also be applied to side and/or custom latching type power outlets and corresponding plugs. For example, referring to FIG. 12, PDU 500 may include respective power outlets 508. These respective power outlets may include side latching mechanisms and may be staggered with respect to each other (similar to those described above) to provide clearance between power outlets to allow for access to latching mechanisms on respective plugs. The PDU 500 may also include one or more power outlets 510, in which the orientation of the power outlet 510 may be varied depending on the application.

It should be appreciated that any of the aspects of the PDUs describe herein may be incorporated into any other PDU. Further, any of the PDUs may be basic PDUs, metered PDUs, switching PDUs, etc. For example, relays and/or other components may be placed between the connection inputs in the space provided by the staggering of the connection inputs. This can help eliminate wasted space provided by such staggering of the connection inputs.

As used herein, the terms "coupled," "coupling," and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and/or described, it will be apparent to those skilled in the art that changes and modifications may be made without departing from the broader aspects of the invention. The actual scope of the protection sought is intended to be defined in the following claims when viewed in their proper perspective.

What is claimed is:

1. A device adapted to receive first and second power connectors, each having a connector width, comprising:

first and second power outlets adapted to respectively receive the first and second power connectors, the first and second power outlets arranged longitudinally along the device, the second power outlet is oriented 180 degrees with respect to the first power outlet, and the second power outlet is staggered with respect to the first power outlet along a width of the device by a first distance of about 35% to 99% of the connector width; and a first recess in the first power outlet and adapted to receive a first latch of the first power connector to couple the first power connector with the first power outlet.

2. The device of claim 1, further comprising a second recess in the second power outlet and adapted to receive a second latch of the second power connector to couple the second power connector with the second power outlet.

3. The device of claim 1, wherein the first distance is about 35% to 49% of the connector width, and the second connector is spaced from the first power outlet longitudinally along the device by a second distance of about 4 mm to 7 mm.

4. The device of claim 1, wherein the first and second power outlets are IEC 60320 C13 or IEC 60320 C15 power outlets.

5. The device of claim 1, wherein the first distance is about 50% to 99% of the connector width, and the second power outlet is spaced from the first power outlet longitudinally along the device by a second distance of about 0 mm to 7 mm.

6. The device of claim 5, wherein the first distance is about 50% to 99% of the connector width, and the second distance is about 0 mm to 4 mm.

7. The device of claim 1, further comprising a tie down portion disposed proximal to the first power outlet.

8. The device of claim 7, wherein the tie down portion is recessed and includes a tie down recess with a bridge portion extending across the tie down recess.

9. A device adapted to receive first and second power connectors, each having a connector width, comprising:

first and second power outlets adapted to respectively receive the first and second power connectors, the first and second power outlets arranged longitudinally along the device, and the second power outlet is staggered with respect to the first power outlet along a width of the device by a first distance of about 35% to 99% of the connector width; and a first recess in the first power outlet and adapted to receive a first latch of the first power connector to couple the first power connector with the first power outlet.

10. The device of claim 9, further comprising a second recess in the second power outlet and adapted to receive a second latch of the second power connector to couple the second power connector with the second power outlet.

11. The device of claim 9, wherein the first distance is about 35% to 49% of the connector width, and the second connector is spaced from the first power outlet longitudinally along the device by a second distance of about 4 mm to 7 mm.

12. The device of claim 9, further comprising a third power outlet arranged longitudinally along the device, and the second and third power outlets are oriented 180 degrees with respect to the first power outlet.

13. The device of claim 9, wherein the second power outlet is spaced from the first power outlet longitudinally along the device by a second distance of about 0 mm 7 mm.

14. The device of claim 9, wherein the first distance is about 50% to 99% of the connector width, and the second power outlet is spaced from the first power outlet longitudinally along the device by a second distance of about 0 mm to 7 mm.

15. The device of claim 14, wherein the first distance is about 50% to 99% of the connector width, and the second distance is about 0 mm to 4 mm.

16. The device of claim 9, further comprising a tie down portion disposed proximal to the first power outlet.

17. The device of claim 16, wherein the tie down portion is recessed and includes a tie down recess with a bridge portion extending across the tie down recess.

18. A device adapted to receive a first power connector, comprising:

a first power outlet adapted to receive the first power connector; and a tie down portion disposed proximal to the first power outlet, wherein the tie down portion is recessed and includes a tie down recess with a bridge portion extending across the tie down recess.

19. The device of claim 18, further comprising a second power outlet adapted to receive a second power connector.

20. The device of claim 19, wherein the first and second power outlets are arranged longitudinally along the device, the second power outlet is oriented 180 degrees with respect to the first power outlet, and the second power outlet is spaced from the first power outlet along a width of the device by a first distance of about 35% to 99% of a connector width of the first power connector.

* * * * *